US006435334B1

(12) United States Patent
Spatafora

(10) Patent No.: US 6,435,334 B1
(45) Date of Patent: Aug. 20, 2002

(54) CIGAR FEED UNIT

(75) Inventor: Mario Spatafora, Bologna (IT)

(73) Assignee: G.D. Societa' per Azioni, Bologna (IT)

( * ) Notice: Subject to any disclaimer, the term of this patent is extended or adjusted under 35 U.S.C. 154(b) by 0 days.

(21) Appl. No.: 09/713,490

(22) Filed: Nov. 15, 2000

(30) Foreign Application Priority Data

Nov. 16, 1999 (IT) ..... B099A0621

(51) Int. Cl.[7] ..... B65G 47/12

(52) U.S. Cl. ..... 198/445; 198/450; 198/467.1; 131/282; 131/283

(58) Field of Search ..... 131/282, 283; 198/445, 447, 449, 450, 467.1

(56) References Cited

U.S. PATENT DOCUMENTS

| | | | | | |
|---|---|---|---|---|---|
| 1,558,398 | A | | 10/1925 | Rose | |
| 3,845,851 | A | * | 11/1974 | Decker et al. | 198/449 |
| 4,265,357 | A | * | 5/1981 | Amberg et al. | 198/444 |
| 4,445,520 | A | * | 5/1984 | Knight et al. | 131/282 |
| 4,660,708 | A | * | 4/1987 | Willerding | 198/341.02 |
| 4,740,113 | A | * | 4/1988 | Hirose et al. | 131/282 |
| 4,903,713 | A | * | 2/1990 | Clarke | 131/282 |
| 5,183,146 | A | * | 2/1993 | Reuteler | 198/444 |
| 5,392,928 | A | * | 2/1995 | Nickey et al. | 198/460.1 |
| 5,531,312 | A | * | 7/1996 | Dickey | 198/450 |
| 6,092,642 | A | * | 7/2000 | Boldrini | 198/418.2 |

FOREIGN PATENT DOCUMENTS

| | | |
|---|---|---|
| EP | 573786 | 12/1993 |
| GB | 783236 | 9/1957 |

* cited by examiner

*Primary Examiner*—Christopher P. Ellis
*Assistant Examiner*—Richard Ridley
(74) *Attorney, Agent, or Firm*—Ladas & Parry

(57) ABSTRACT

A unit for feeding cigars from an input hopper to a pocket conveyor for feeding single cigars successively along a given path, wherein the cigars are fed along a downfeed channel, an outlet of which faces a rotary transfer member for feeding the cigars successively into respective pockets on the conveyor and in time with the pockets; the channel receives a column of superimposed cigars oriented cross-wise to their feed direction along the channel; and a screw conveyor extends along at least one end portion of the channel to feed single cigars successively to the outlet of the channel in time with the transfer member.

14 Claims, 2 Drawing Sheets

CIGAR FEED UNIT

The present invention relates to a cigar feed unit. More specifically, the present invention relates to a unit for feeding single cigars from a hopper to a pocket conveyor.

BACKGROUND OF THE INVENTION

In known cigar feed devices, the cigars are piled inside a hopper having at least one bottom outlet connected to a respective downfeed channel, and both the hopper outlet and the downfeed channel are so sized as to permit successive passage of single cigars oriented crosswise to the feed direction along the downfeed channel. The cigars are fed by force of gravity, one on top of the other, down the channel; and a movable gate at the bottom retains the stack of cigars inside the channel, and is opened intermittently to feed single cigars onto a feed conveyor.

In such devices, the cigars are substantially allowed to drop one by one onto the feed conveyor, and, being fragile, are therefore subject to damage on impact.

SUMMARY OF THE INVENTION

It is an object of the present invention to provide a cigar feed unit designed to eliminate the aforementioned drawbacks, and which, in particular, provides for feeding single cigars in controlled manner at all times into the respective pockets on the pocket conveyor.

According to the present invention, there is provided a cigar feed unit, the unit comprising a pocket conveyor having a number of pockets and for feeding single cigars successively in a given direction, and a feed device for feeding said cigars successively into respective said pockets in time with the pockets; said feed device comprising an input hopper, and at least one channel having an inlet communicating with said hopper, and an outlet facing said pocket conveyor; the channel having a longitudinal axis extending downwards towards said outlet, and receiving a number of cigars oriented crosswise to said axis; and the feed unit being characterized in that said feed device also comprises at least one movable transfer member interposed between said outlet and said pocket conveyor, and for feeding said cigars successively into respective said pockets; and conveying means extending along at least part of said channel to feed single cigars successively to said outlet in time with said transfer member.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
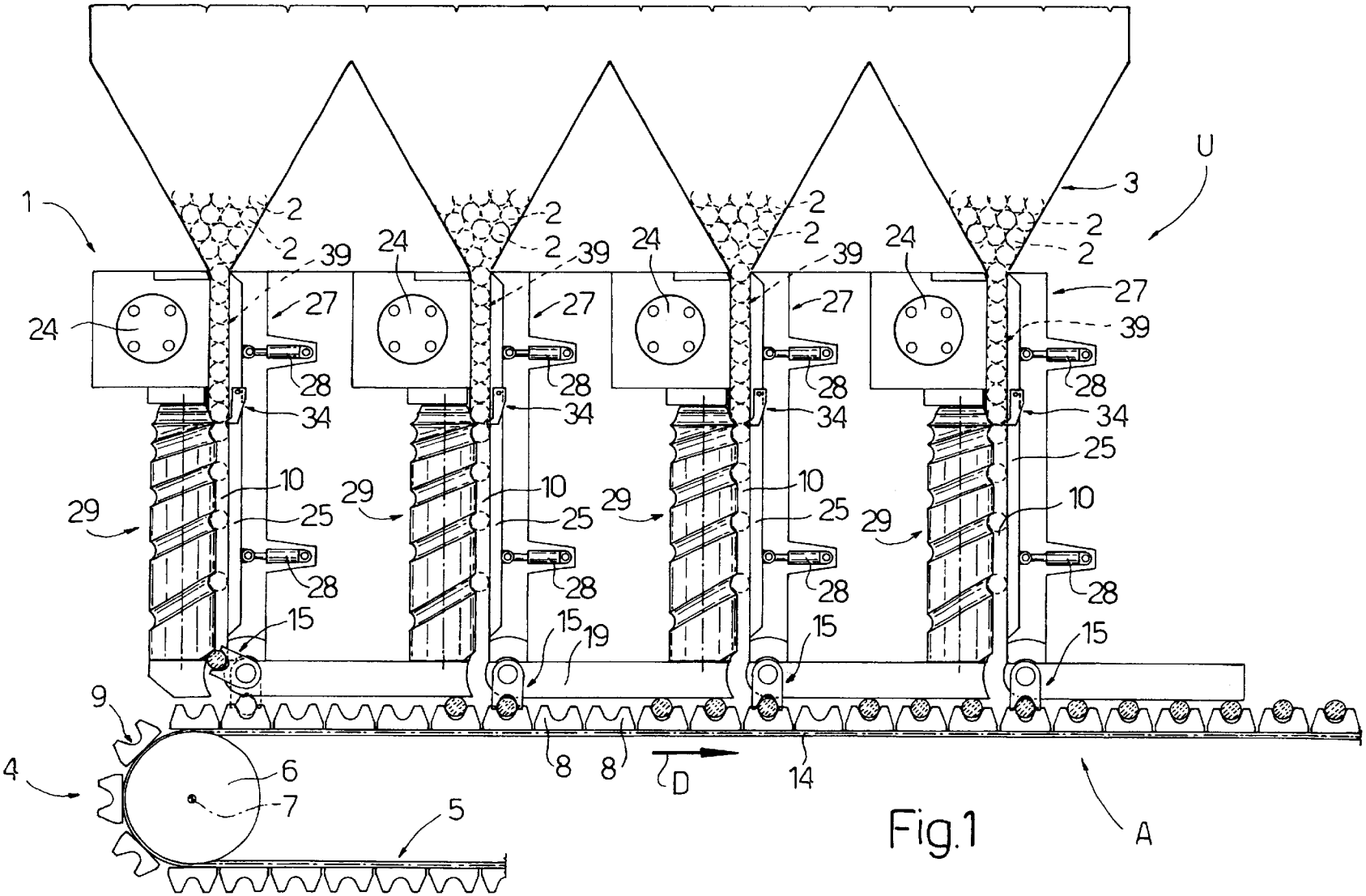
FIG. 1 shows a schematic side view, with parts removed for clarity, of a cigar conditioning machine featuring a cigar feed unit in accordance with the teachings of the present invention.
Figure 2:
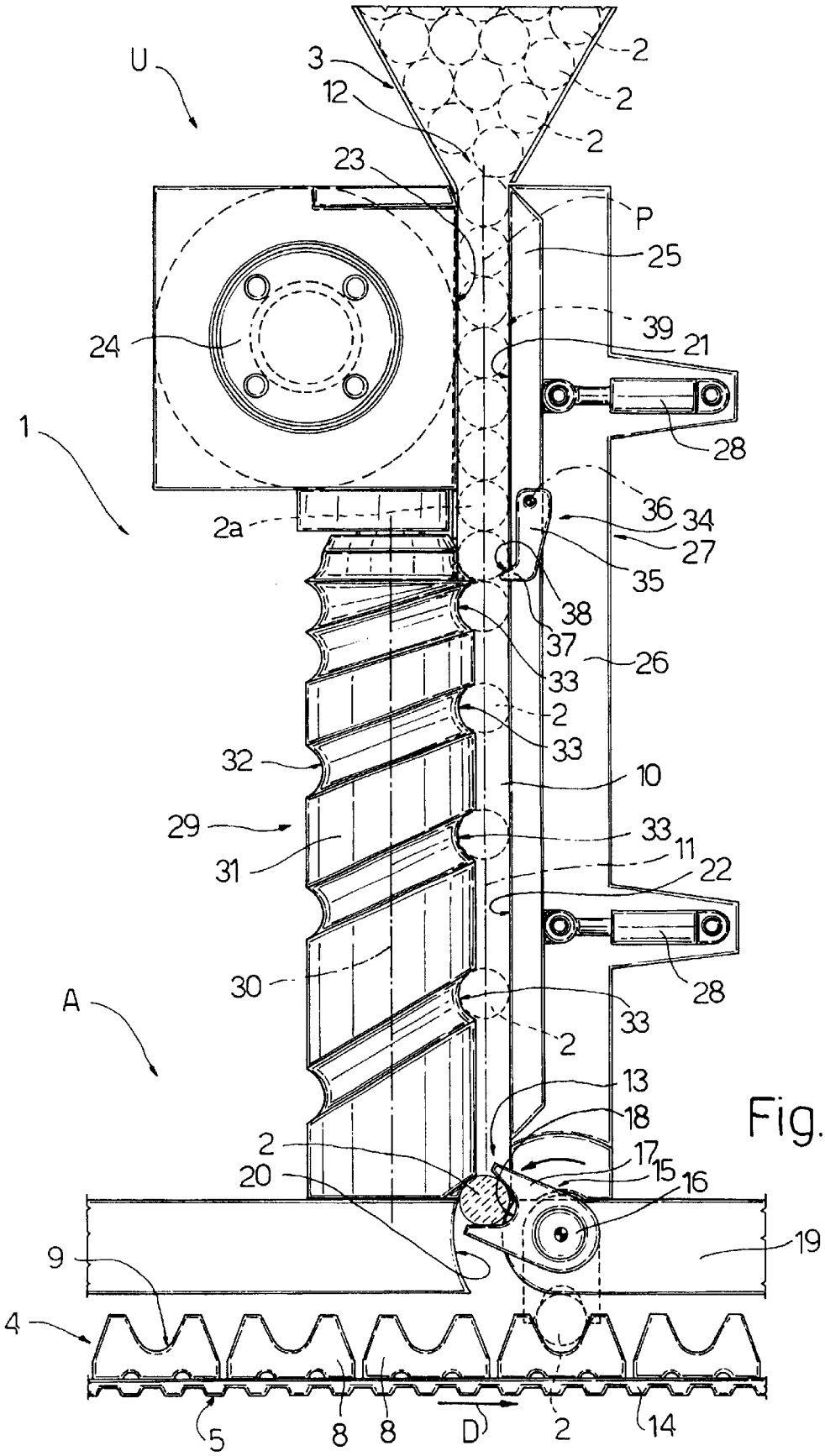
FIG. 2 shows a larger-scale detail of FIG. 1.

The letter U in FIG. 1 indicates as a whole a feed unit defining an input portion of a cigar conditioning machine A, and comprising a feed device 1 for feeding cigars 2 successively from a hopper 3 forming part of feed device 1, to a conveyor 4 forming part of unit U and for transferring cigars 2, in a given feed direction D, to a known conditioning station not shown.

Conveyor 4 comprises a belt 5 looped about two pulleys 6 (only one of which is shown, and only one of which is normally powered) having respective axes 7 of rotation (only one shown) perpendicular to the FIG. 1 plane; and a number of blocks 8 equally spaced along the outer surface of belt 5, and each having a groove extending parallel to axes 7 and defining a respective pocket 9 for receiving a respective cigar 2 oriented with its longitudinal axis parallel to axes 7 and crosswise to direction D.

Feed device 1 is designed to feed cigars 2 selectively along a number of substantially vertical feed paths P (in the example shown, paths P are four in number, but may range from one to any number n); and each path P is defined by a downfeed channel 10 having a substantially vertical longitudinal axis 11 crosswise to both direction D and axes 7. More specifically, when, as in the example shown, channels 10 are of a number n greater than one, the distance between the axes of channels 10 equals a length of belt 5 of conveyor 4 spanning n+1 blocks 8 (corresponding to n+1 pockets 9). Each channel 10 has a top inlet 12 coincident with a respective bottom opening in hopper 3; and a bottom outlet 13 facing a top conveying branch 14 of conveyor 4.

For each channel 10, feed device 1 comprises a transfer member 15 interposed between respective outlet 13 and branch 14, and for transferring cigars 2 successively from respective channel 10 to respective pockets 9 on conveyor 4.

Each transfer member 15 is a rotary transfer member, which is oriented crosswise to conveyor 4, is substantially U-shaped, and comprises a shaft 16 located over top branch 14 of conveyor 4 and powered to rotate (anticlockwise in FIG. 1) about a respective axis parallel to axes 7. Each transfer member 15 also comprises two parallel, facing appendixes 17 (only one shown) projecting radially from opposite ends of respective shaft 16 and located on opposite sides of top branch 14. The free end of each appendix 17 has a groove, which, together with the groove, aligned with it, of the other appendix 17, defines a seat 18 for receiving a respective cigar 2. The length of appendixes 17 is such that, when the appendixes 17 in each pair of appendixes 17 are positioned perpendicular to top branch 14 of conveyor 4, respective seat 18 is so positioned as to define, with a pocket 9 facing it, a movable, substantially cylindrical seat (FIG. 1) for housing a respective cigar 2 with no interference.

Transfer members 15 and conveyor 4 are so synchronized (in known manner not shown) as to enable each transfer member 15 to feed a respective cigar 2 into and in time with a respective pocket 9.

Once transferred into respective pockets 9, cigars 2 are retained inside pockets 9 by guide plates 19, which form part of feed device 1, are aligned in direction D over conveyor 4, and face top branch 14 of conveyor 4. During transfer from respective channel 10 to respective pocket 9, each cigar 2 is fed by respective transfer member 15 along a circular guide channel 20, which communicates with outlet 13 of respective channel 10 and is defined by a respective slot formed through one end of a respective plate 19 to guide and, at the same time, retain cigar 2 inside relative seat 18.

Each channel 10 and respective inlet 12 are shaped to permit the passage of only one cigar 2 at a time. More specifically, each channel 10 comprises a first and a second portion 21 and 22 arranged in series as of respective inlet 12 and aligned with each other along respective axis 11. Portion 21 is defined, on one side, by a vertical lateral surface 23 of a fixed casing of a motor 24 forming part of feed device 1, and, on the opposite side, by a plate 25 also forming part of feed device 1 and which is supported by a fixed frame 26 via the interposition of a size adjusting device 27 for adjusting and so adapting the width of channel 10 to the diameter of cigars 2 being processed. In the example embodiment shown, size adjusting device 27 comprises two linear actuators 28 interposed between frame 26 and plate 25 and extending parallel to direction D; and fixed guides (not shown) parallel to direction D and engaged in sliding manner by plate 25.

Portion 22 is defined, on one side, by plate 25, which extends substantially the whole length of channel 10, and, on the other side, by one, but normally at least two screw conveyors 29 (only one shown). Screw conveyors 29 form part of feed device 1, are arranged side by side in a direction parallel to axes 7, and are activated by motor 24 to rotate about respective axes 30 (only one shown) parallel to axis 11 and to plate 25, and located the same distance from plate 25. Each screw conveyor 29 is defined by a cylindrical core 31 coaxial with respective axis 30, and by a groove 32 which winds about core 31 in a variable-pitch spiral, wherein the pitch increases gradually towards outlet 13 of respective channel 10 from an initial value, substantially equal to the width of groove 32, to a value greater than the width of groove 32. Groove 32 has a circular section of a diameter approximately equal to but no smaller than the diameter of cigars 2 being processed, and each turn of groove 32 defines, together with plate 25, a movable seat 33 for receiving and feeding a respective cigar 2 to outlet 13 of respective channel 10 according to a given law of motion, so that cigars 2 are spaced apart along portion 22 of respective channel 10 and are fed successively to and in time with respective transfer member 15.

Finally, for each channel 10, feed device 1 comprises a timing member 34 in turn comprising a lever 35, which is parallel to and located outside respective channel 10, is hinged at the top end to respective plate 25 to rotate about an axis 36 parallel to axes 7, and has, at the bottom end, a substantially horizontal tooth 37, which extends crosswise to lever 35, is defined at the top by a sloping surface 38 forming an obtuse angle with lever 35, and is movable, by downward pressure applied to surface 38, between a stably balanced rest position in which tooth 37 penetrates respective channel 10 at the joint between portions 21 and 22 and at the top of screw conveyor 29, and a work position in which tooth 37 is located outside respective channel 10.

In actual use, cigars 2 from hopper 3 flow into each channel 10 through respective inlet 12, drop down channel 10 by force of gravity, and at the same time are arrested in first portion 21 of channel 10 to form, along the whole of portion 21 of channel 10, a column 39 of cigars 2 arranged laterally contacting one another.

Column 39 is formed by the combined arrest and support action of the top ends of relative screw conveyors 29 and of the top surface 38 of relative tooth 37 in the normal rest position. More specifically, inside each channel 10, screw conveyors 29 interfere partly with channel 10 (substantially to a depth equal to the depth of respective grooves 32) to temporarily arrest and support column 39 inside portion 21, and respective tooth 37 cooperates with screw conveyors 29 to prevent the leading cigar 2 in column 39 (with reference to the traveling direction of column 39)—hereinafter referred to as cigar 2*a*— from rolling slightly about its own axis and so getting wedged inside the inlet of portion 22 and in a position in which it might be damaged by screw conveyors 29.

Each cigar 2*a* is withdrawn by screw conveyors 29 and fed towards outlet 13 of the channel along second portion 22 of channel 10. Engagement of cigar 2*a* by screw conveyors 29 and the thrust exerted by screw conveyors 29 on cigar 2*a* generate, on the sloping top surface 38 of stop tooth 37, a force which, on account of the slope of surface 38, can be divided into a first vertical downward component, and a second component directed in direction D and capable of moving timing member 34 from the rest to the work position.

Cigars 2 are therefore withdrawn successively, and with no risk of damage, by relative screw conveyors 29, which feed the cigars successively, and with said given law of motion, along second portion 22 of channel 10 to outlet 13 of channel 10. As they are fed along portion 22, cigars 2 are housed inside respective seats 33, and are gradually spaced a given distance apart along path P by the gradual variation in the pitch of screw conveyors 29.

At outlet 13 of each channel 10, the cigars 2 fed along channel 10 are fed successively by screw conveyors 29 to, and in time with, respective transfer member 15, and are fed by transfer member 15 along channel 20 and into, and in time with, respective pockets 9 on conveyor 4.

What is claimed is:

1. A cigar feed unit, the unit (U) comprising a pocket conveyor (4) having a number of pockets (9) and for feeding single cigars (2) successively in a given direction, and a feed device (1) for feeding said cigars (2) successively into respective said pockets (9) in time with the pockets (9); said feed device (1) comprising an input hopper (3), and at least one channel (10) having an inlet (12) communicating with said hopper (3), and an outlet (13) facing said pocket conveyor (4); the channel (10) having a longitudinal axis (11) extending downwards towards said outlet (13), and receiving a number of cigars (2) oriented crosswise to said axis (11); and the feed unit (U) being characterized in that said feed device (1) also comprises at least one movable transfer member (15) interposed between said outlet (13) and said pocket conveyor (4), and for feeding said cigars (2) successively into respective said pockets (9); and conveying means (29) extending along at least part of said channel (10) to feed single cigars (2) successively to said outlet (13) in time with said transfer member (15).

2. A unit as claimed in claim 1, characterized in that said channel (10) comprises a first and a second portion (21; 22) in series with each other, the first (21) having said inlet (12), and the second (22) having said outlet (13); said conveying means (29) extending along said second portion (22) and interfering with said channel (10) to define, inside said first portion (21), a column (39) of superimposed cigars (2) contacting one another.

3. A unit as claimed in claim 2, characterized in that said conveying means (29) laterally define said second portion (22) of said channel (10).

4. A unit as claimed in claim 1, characterized in that said conveying means (29) are variable-pitch conveying means.

5. A unit as claimed in claim 4, characterized in that said pitch increases in value towards said outlet (13).

6. A unit as claimed in claim 1, characterized in that said conveying means (29) comprise at least one screw extending parallel to said longitudinal axis (11).

7. A unit as claimed in claim 6, characterized in that said screw comprises a cylindrical core (31), and a groove (32) winding in a cylindrical spiral about said core (31); said groove (32) having a circular section to define, along said channel (10), a succession of first movable seats (33), each for receiving a respective said cigar (2).

8. A unit as claimed in claim 7, characterized in that said first movable seats (33) are spaced along said channel (10) with a variable pitch increasing in value towards said outlet (13).

9. A unit as claimed in claim 8, characterized in that said variable pitch varies from a minimum value equal to a width of said groove (32).

10. A unit as claimed in claim 1, characterized by comprising a plate (25) extending, parallel to said axis (11), along said channel (10) and facing said conveying means (29); said plate (25) cooperating with said conveying means (29) to laterally define said channel (10).

11. A unit as claimed in claim 1, characterized by comprising a size adjusting device (27) for adjusting a width of said channel (10); said size adjusting device (27) comprising a plate (25) extending, parallel to said axis (11), along said channel (10) and facing said conveying means, and actuating means (28) connected to said plate (25) to move the plate (25), crosswise to said axis (11), to and from said conveying means (29).

12. A unit as claimed in claim 1, characterized in that said transfer member (15) comprises at least one second movable seat (18) for housing a respective said cigar (2), and is mounted to rotate about an axis of a shaft (16) crosswise to said axis (11), to move said second movable seat about the axis of said shaft (16) in time with said conveying means (29) and said pocket conveyor (4).

13. A unit as claimed in claim 2, characterized in that timing means (34) are provided along said channel (10), between said first and said second portion (21; 22); said timing means (34) cooperating with said conveying means (29) to temporarily support and arrest a column (39) of cigars (2) inside said first portion (21) of the channel (10) and at a top end of the conveying means (29).

14. A unit as claimed in claim 13, characterized in that said timing means (34) comprise a lever (35) substantially parallel to said axis (11) and located laterally outside said channel (10); and a tooth (37) projecting laterally from a bottom end of said lever (35), which is hinged at the top to rotate, with respect to said channel (10) and by force of gravity, into a rest position wherein said tooth is located inside said channel and in a position interfering with a feed path of said cigars (2) along the channel (10).

* * * * *

UNITED STATES PATENT AND TRADEMARK OFFICE

CERTIFICATE OF CORRECTION

PATENT NO. : 6,435,334 B1
DATED : August 20, 2002
INVENTOR(S) : Mario Spatafora

It is certified that error appears in the above-identified patent and that said Letters Patent is hereby corrected as shown below:

Title page,
Item [*], “5 days” should read -- 65 days --.

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,435,334 B1
DATED : August 20, 2002
INVENTOR(S) : Mario Spatafora

It is certified that error appears in the above-identified patent and that said Letters Patent is hereby corrected as shown below:

Title page,
Item [73], the correct name of the Assignee is -- G.D Societa' Per Azioni --

Signed and Sealed this

Twenty-fifth Day of March, 2003

JAMES E. ROGAN
*Director of the United States Patent and Trademark Office*